US005793708A

United States Patent [19]

Schmidt et al.

[11] Patent Number: 5,793,708

[45] Date of Patent: Aug. 11, 1998

[54] TIMEPIECE WITH A CHRONOGRAPH MECHANISM

[75] Inventors: Marc Schmidt, Gland, Switzerland; Michel Sintes, Bonne, France

[73] Assignee: Montres Rolex S.A., Geneva, Switzerland

[21] Appl. No.: 741,181

[22] Filed: Oct. 29, 1996

[30] Foreign Application Priority Data

Oct. 31, 1995 [CH] Switzerland ..... 03077/95

[51] Int. Cl.[6] ..... G04F 8/00

[52] U.S. Cl. ..... 368/106; 368/110; 368/220

[58] Field of Search ..... 368/220, 223, 368/88, 76, 80, 106, 110

[56] References Cited

U.S. PATENT DOCUMENTS

| | | | |
|---|---|---|---|
| 3,903,686 | 9/1975 | Burki | 368/106 |
| 4,351,040 | 9/1982 | Aoki | 368/88 |
| 4,389,122 | 6/1983 | Dubois et al. | 368/110 |
| 4,588,305 | 5/1986 | Piguet et al. | 368/185 |
| 5,113,382 | 5/1992 | Bron | 368/106 |
| 5,339,293 | 8/1994 | Kamiyama et al. | 368/110 |

FOREIGN PATENT DOCUMENTS

| | | |
|---|---|---|
| 2 176 158 | 10/1973 | France . |
| 623 980 | 7/1981 | Switzerland . |
| 1 257 455 | 12/1971 | United Kingdom . |
| 1 412 340 | 11/1975 | United Kingdom . |

*Primary Examiner*—Bernard Roskoski
*Attorney, Agent, or Firm*—Henderson & Sturm

[57] ABSTRACT

A chronograph mechanism comprises a coupling member (17) engaging, on the one hand, with a pinion (15") solid with the seconds wheel and, on the other hand, with the chronograph's seconds wheel (18). This coupling member (17) also carries a retractable finger (27) adapted to drive, each turn, the first rotatable member (35) of a cinematic transmission connecting together a rotatable member (38) of the minutes wheel to that of the hours counter (41). This transmission is indexed, between two drives by the retractable finger (27), by a jumper (51) engaged in an intermediate wheel (37) of this transmission. The coupling member (17) is controlled by two levers (44, 45), one lever (44) carrying a pin (44c) which, in the uncoupled position, locks the jumper (51) in the intermediate wheel (37)'s toothing. The minutes and hours counter rotatable members (38, 41), solid with zero setting cams (42, 43), are friction fitted on their respective axles.

6 Claims, 5 Drawing Sheets

4
6
5
60
61
52
57
55
64
54a
56
59
62a
62
63
53
54
2
50
44b
68
II
65
66
38
71
42
67
38a
48
58
44
37
46
51
35'
76
18
II
69a
II
45a
77
44a
72
40'
35
47
74
69
40
45
41
17
73
75
43
70
41a
II
3
1

19
38
39a
42
37
35
35'
40
40'
43
39b
41
38a
27
18
41a
51
F
1
17
34
26a
50
44c
28
26
15
44b
46
44
45
47
48
49
44a
45a

TIMEPIECE WITH A CHRONOGRAPH MECHANISM

The present invention relates to a timepiece with a chronograph mechanism comprising seconds, minutes and hours counters, having three respective indicating members each solid for rotation with a rotatable member, coupling means for selectively placing these rotatable members in engagement with a gear train of the timepiece, a device for controlling these coupling means and a zero-setting mechanism for the indicating members.

In prior art chronograph mechanisms, a first gear train mechanism serves for counting the minutes and seconds and is arranged on one side of the movement, generally that side carrying the support bars. A second gear train mechanism driving the hour-counting indicator is arranged on the other side, i.e. the side adjacent to the dial.

These gear train mechanisms occupy a large space: the surface area occupied by these first and second gear train mechanisms can generally be evaluated at 50% or 30% respectively. These mechanisms occupy height because they are arranged on both sides of the movement, so that these chronographs either increase the overall volume of the timepiece, or reduce the volume available for other essential components of the timepiece, i.e. the barrel, the balance and an automatic winding mechanism. It should be remembered that the barrel volume determines the watch's power reserve and the balance diameter is decisive for its precision.

The fact that the seconds and minutes, on the one hand, and the hours, on the other hand, are counted by two separate and mutually independent gear train mechanisms may, in certain use conditions lead to a lag between the minutes counter indications and those of the hour counter.

This lag is a result of the cumulative counting of several time intervals during which the chronograph mechanism is alternately set in action and stopped several times without any intervening zero-settings.

The minutes-counter indicator is driven by the chronograph's seconds wheel, which itself is driven by the watch movement's seconds wheel. As for the hours-counter indicator, this is driven by the barrel. When the chronometer timing action is interrupted, the drive wheels of the chronograph gear train mechanisms are uncoupled and these mechanisms continue to turn.

At the moment of recoupling, the toothing of a gear wheel mounted on a lever comes to engage with the toothing of the drive wheel. Due to the fact that during stoppage the drive wheel continues to rotate, the two toothings are not necessarily in position to mesh together at the moment when they come back into engagement with one another. As a result of the fact that the drive wheel is subjected to the tension exerted by the barrel spring on the entire cinematic linkage between the barrel and the escapement, the chronograph counter gear train mechanism is slightly angularly displaced so that the toothed wheels can mesh with one another. This slight rotation is imperceptible for the gear train of the minutes and seconds counter, taking into account the large number of teeth, which is chosen to be a high number so as to reduce the angular displacement resulting from uncoupling. However, the hours counter gear train necessarily has a less fine toothing, so that the angular lag is more perceptible. In the case of cumulative chronometers, these angular lags can add up until they produce a visible and unwanted difference between the position of the minutes counter hand and that of the hours counter.

It has already been proposed to drive the minutes counter gear train once per minute using a retractable finger solid for rotation with a wheel turning once per minute, generally a setting wheel driving the seconds and minutes indicators in the same direction.

When the counters are set to zero, this finger returns to its starting position cutting across the path of the teeth of the wheel driven normally by this finger. At the same time, this wheel, driven by the minutes gear train which is also brought back to its starting position, turns in the reverse direction to return to its zero position. Because of this, during this double rotation in opposite directions, this finger is liable to touch against up to 15 teeth of this wheel and must retract on touching each tooth, leading to wear of the teeth and of the finger.

It has already been proposed to replace this type of coupling with a friction coupling between coaxial circular members one of which is axially movable against the action of a spring tending to apply them against one another. This coupling device with axial displacement of the coupling members occupies a substantial height. Given that it is located on the axis of the chronograph's seconds wheel, which is arranged centrally in the movement and on which other rotatable parts are mounted (center wheel, cannon pinion) the movement's thickness is even further increased. Moreover, in the case of an automatically wound watch, the pivoting system of the oscillatory winding head is superimposed on the above-mentioned members on the movement's central axis, leading to a watch of substantially increased thickness.

The present invention aims to at least partly remedy the above-mentioned drawbacks.

To this end, the invention concerns a timepiece with a chronograph mechanism according to claim 1.

The solution according to the invention offers numerous and significant advantages. This solution enables the number of constituent parts of the chronograph mechanism to be reduced by about 50% compared to conventional mechanisms. This mechanism is consequently very compact. Because the entire gear train mechanism of the chronograph is driven by a single member, this complete mechanism can be placed on one and the same side of the movement. Decentring of the coupling device enables reduction of the space requirements at the center of the movement allowing, if required, space for fitting an automatic winding module whose oscillatory mass pivots about an axis located centrally of the movement without unwanted increase of the thickness thereof.

The simplification of the chronograph mechanism also leads to greater reliability. Periodic driving of the hours and minutes indicator members by the timepiece's gear train also allows reduction of the power provided by this gear train to drive the chronograph mechanism. Moreover, due to the cinematic transmission connecting the hours and minutes counters, one single indexing member is necessary, thereby also reducing the energy required to drive this transmission.

Although certain of the above-mentioned advantages are associated more particularly with mechanical timepieces, the invention is not limited thereto. The timepiece could also be an electronic one, in particular a quartz watch with a rotating display, notably an analog display. Also, in the case of a mechanical timepiece, it may be with automatic winding or manual winding.

The accompanying drawings illustrate, schematically and by way of example, one embodiment of a timepiece with a chronograph mechanism according to the invention.

Figure 1:
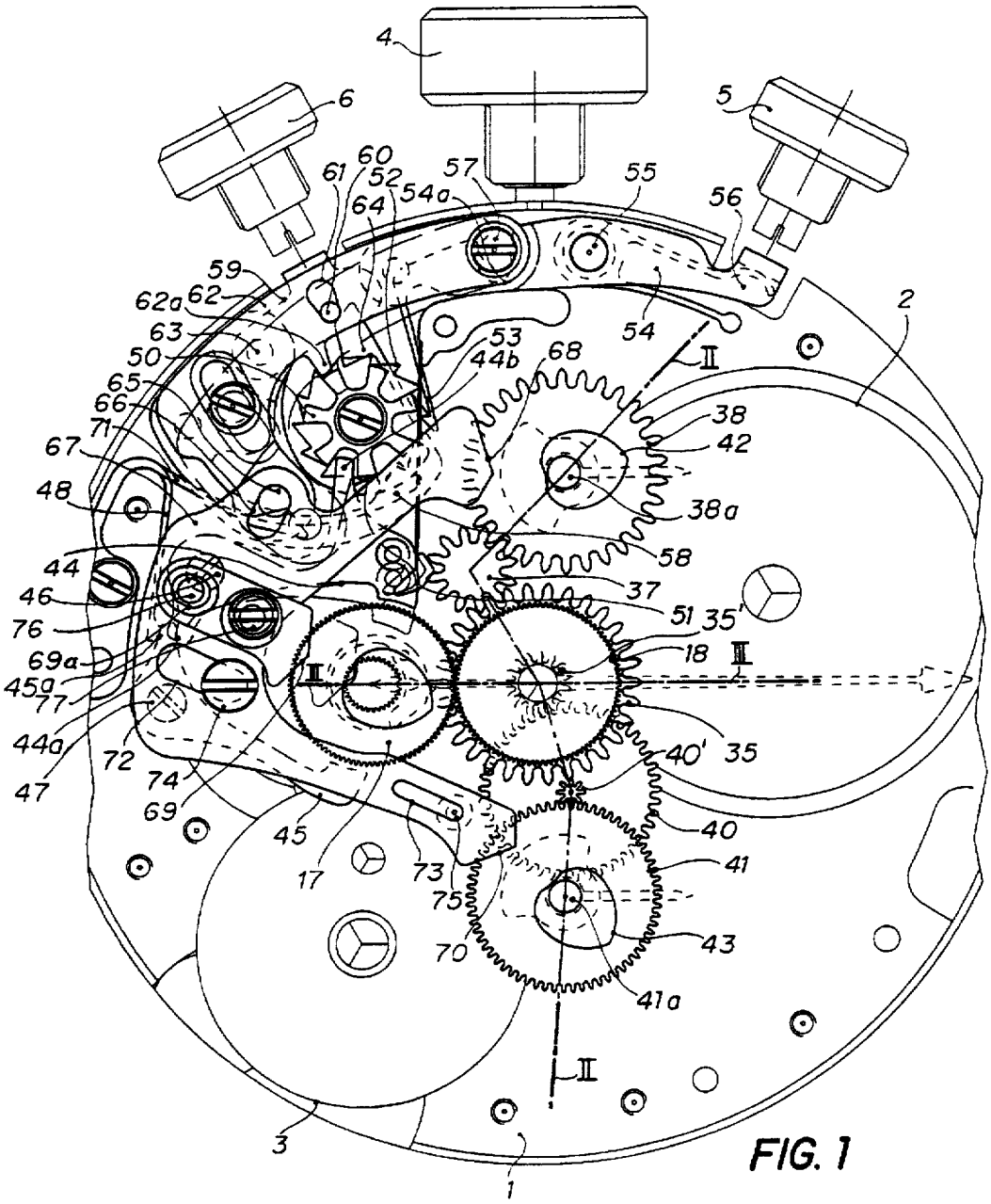
FIG. 1 is an overall plan view from the side of the support bars of the movement of this timepiece.
Figure 2:
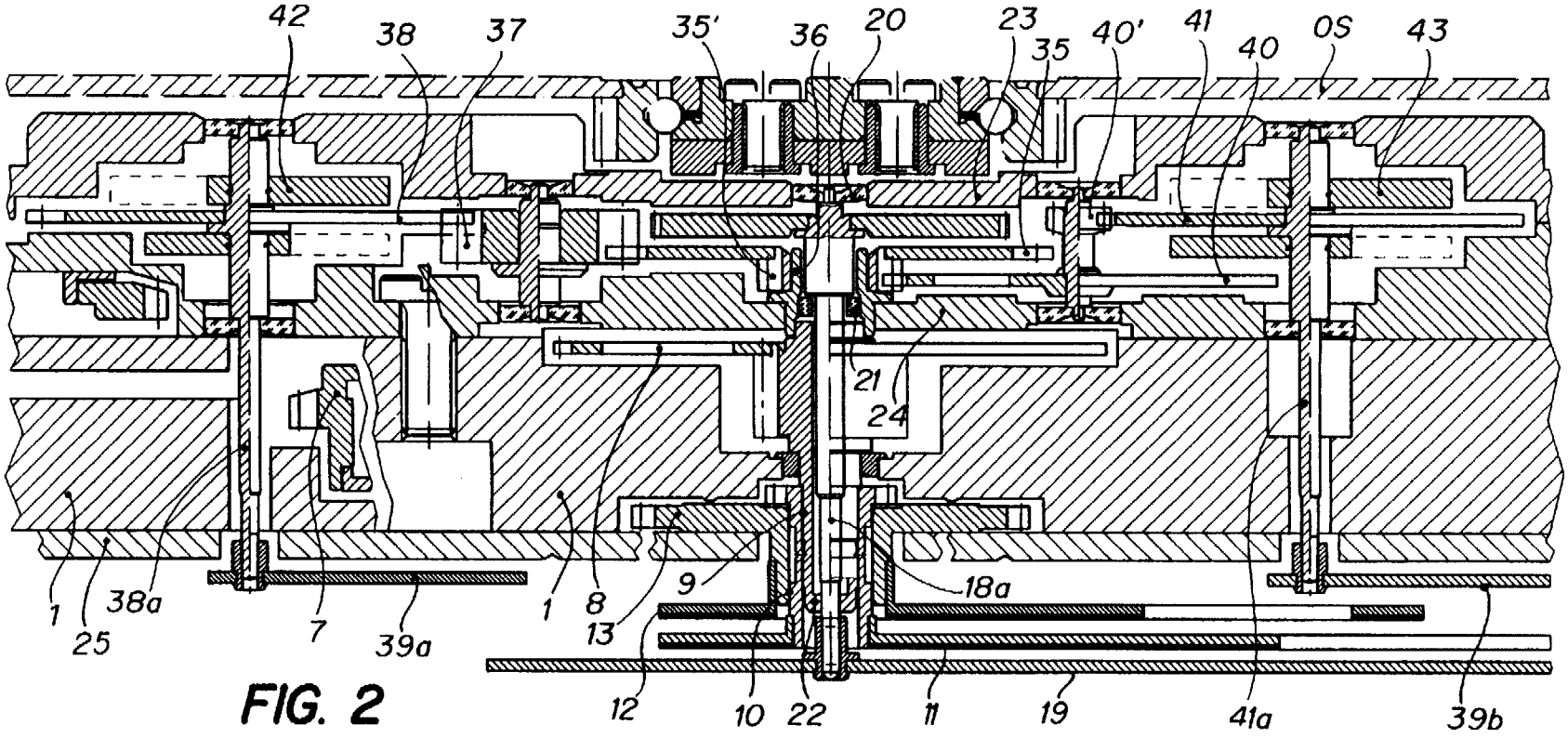
FIG. 2 is a view in cross section along line II—II of FIG. 1.
Figure 3:
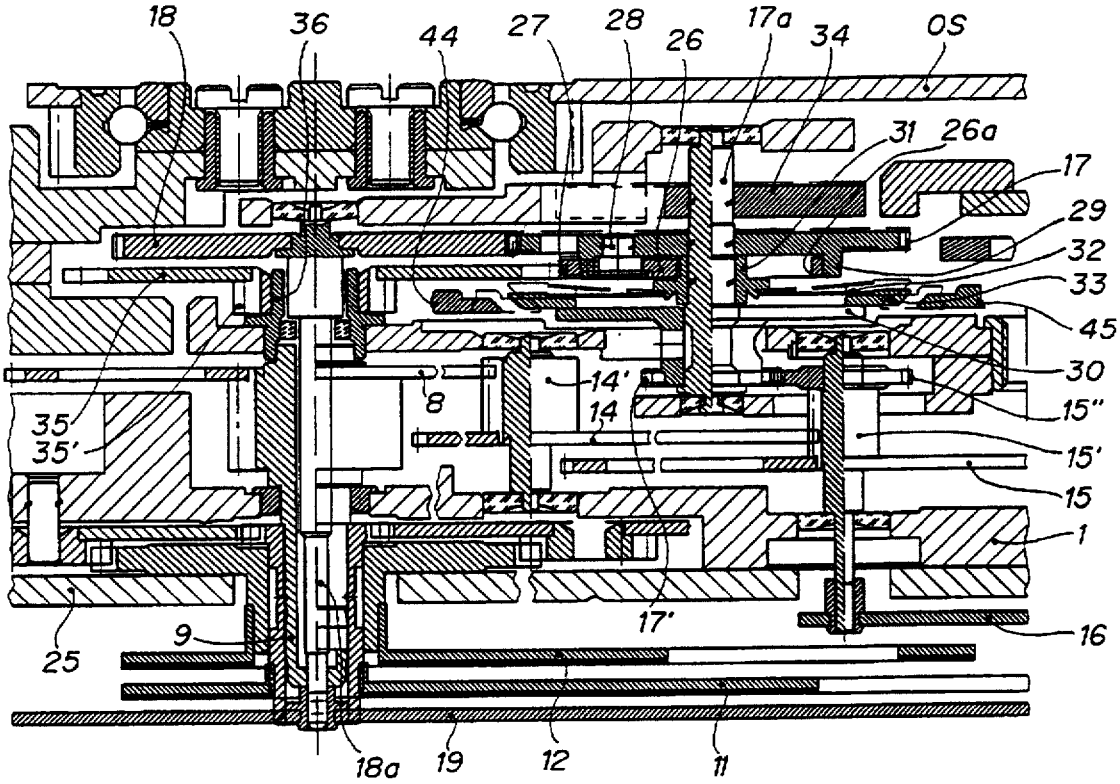
FIG. 3 is a view in cross section along line III—III of FIG. 1.
Figure 4:
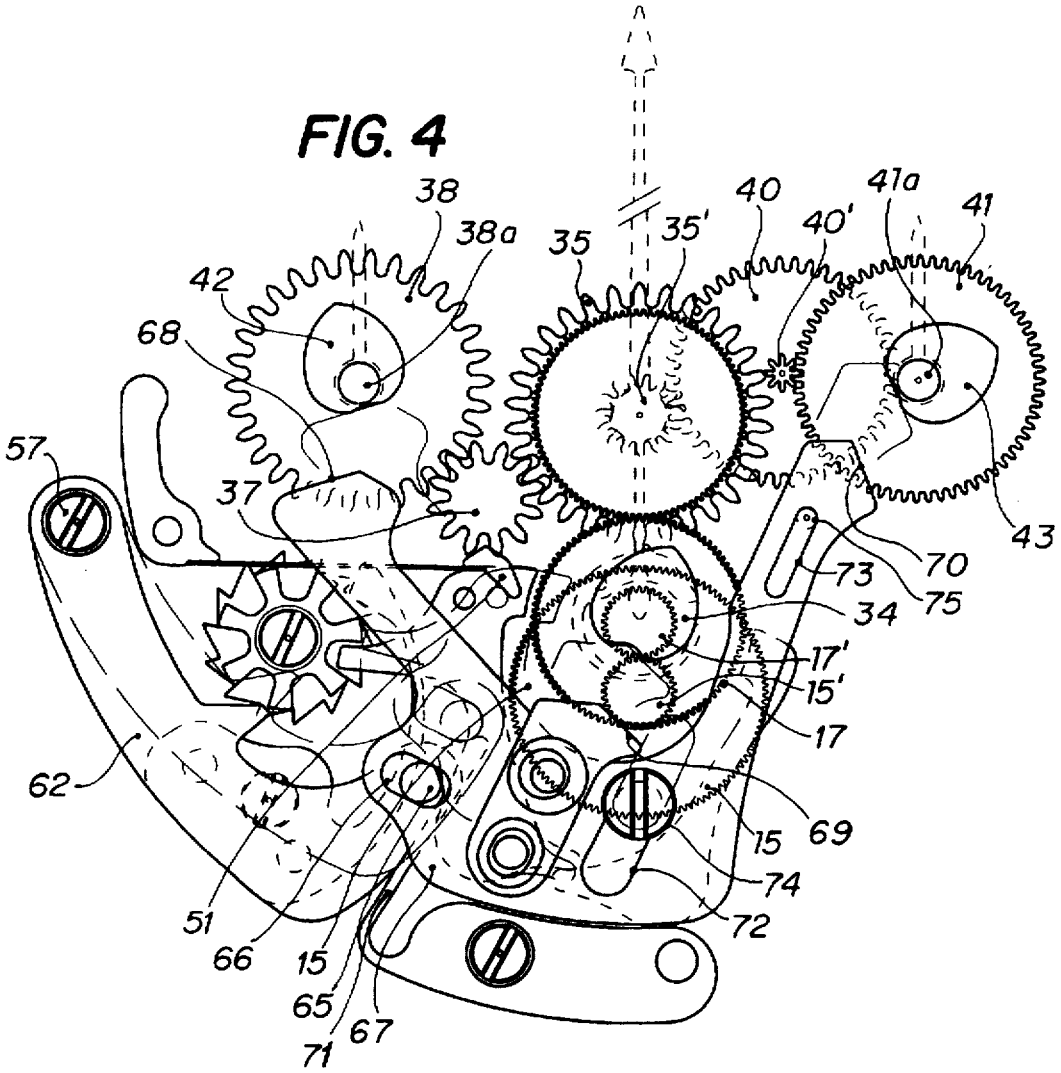
FIG. 4 is a partial plan view of FIG. 1 showing only part of the chronograph mechanism.

The timepiece illustrated in FIG. 1 to 3 is an automatic winding timepiece with a chronograph mechanism. FIG. 1 illustrates the bottom plate 1, showing the locations of the barrel recess 2 and the balance recess 3. It also illustrates the location of the winding stem fixed to the winding crown 4 as well as that of two chronograph push-pieces 5 and 6 controlling respectively the starting/stopping and the zero setting of the chronograph.

On FIG. 2 can be seen the barrel 7 as well as the center wheel 8 whose shaft 9 carries the cannon-pinion 10 on which is force-fitted the minutes hand 11, the hours hand 12 being fixed to the hour wheel 13. FIG. 3 illustrates the same members and also the following wheel 14 whose pinion 14' meshes with the center wheel 8. This following wheel 14 meshes with a pinion 15' of the seconds wheel 15 carrying an eccentric seconds hand 16.

The remainder of the timepiece mechanism is well known to the person skilled in the art and, as it is outside the scope of the present invention, will not be described here as such description is not necessary to understand the invention.

It is from the seconds wheel 15 onwards that the entire gear train of the chronograph mechanism according to the invention is driven periodically in response to commands. The shaft of the seconds wheel 15 carries a pinion 15" meshing with a pinion 17' freely pivotally mounted on the shaft of a coupling wheel 17 of the chronograph, this wheel being solid with its shaft 17*a*. Details of the coupling mechanism associated with this coupling wheel 17 will be described later. The gear ratios between pinions 15" and 17' is 1/1, so that the speed of rotation of the coupling wheel 17 is identical to that of the seconds wheel 15.

The coupling wheel 17 meshes with a wheel 18 constituting the chronograph seconds wheel and which has the same number of teeth as the coupling wheel 17, so that it turns at the same speed as the coupling wheel 17 and, consequently, as the seconds wheel 15. Taking into account the inversion of the direction of rotation of the two wheels meshing together, the chronograph seconds wheel 18 turns in the same direction as the seconds wheel 15 of the timepiece movement. The shaft 18*a* of this chronograph seconds wheel 18 carries the chronograph seconds hand 19 and passes through the tubular shaft 9 of the center wheel 8 relative to which it pivots freely in bearings 20, 21, 22 solid respectively with: a support bar 23 carrying the chronograph gear train; a support bar 24 of the timepiece gear train fixed on one face of the bottom plate 1 whose opposite face carries a dial 25; and with the tubular shaft 9 of the center wheel 8.

Figure 5:
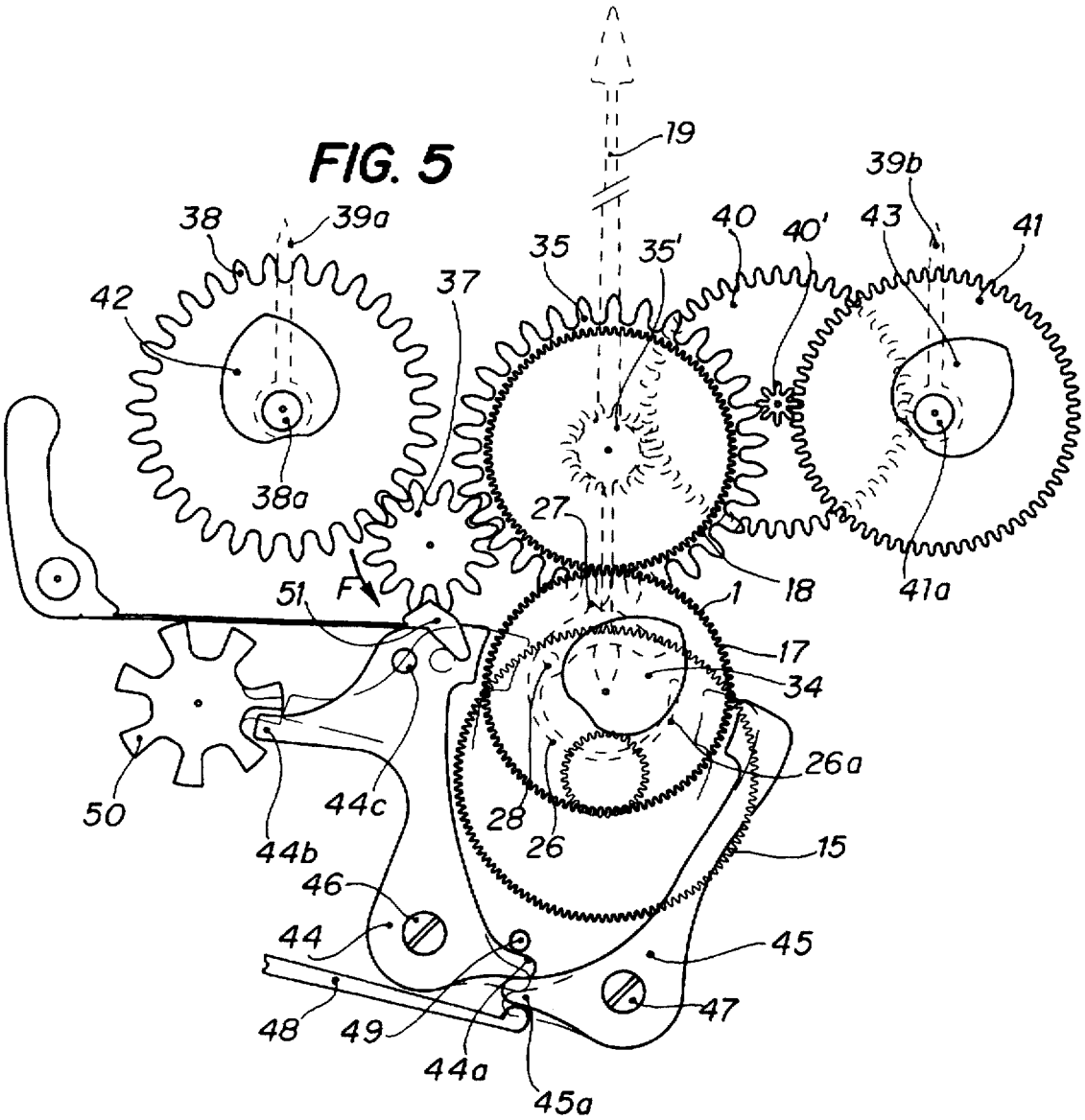
FIG. 5 is a partial plan view of FIG. 1 showing only another part of the chronograph mechanism.

The coupling wheel 17 also carries a second annular drive member in the form of an open ring 26 comprising a retractable triangular-shaped finger 27 protruding radially towards the outside of the ring (FIGS. 3 and 5). This annular drive member 26 is pivotally mounted on a stud 28 force fitted in the coupling wheel 17. From this stud onwards, the drive member 26 becomes progressively thinner to form a biassing spring 26*a* of the drive member 26 incorporated in this member 26. The part 26*a* of the drive member 26 is housed in a recess 29 of the coupling wheel 17. The retractable finger 27 cuts across the path of a first wheel 35 of the chronograph's counter gear train, in a manner to drive this wheel for each rotation of the coupling wheel 17.

The pinion 17' of coupling wheel 17 is solid with a coupling disk 30 (FIG. 3) that rotates continuously with the pinion 17 meshing with seconds wheel 15. A collet 31 is force fitted on coupling wheel 17's shaft 17*a*. An elastic disk 32 is riveted onto this collet and carries, at its periphery, a coupling ring 33. The elastic disc 32 elastically applies the coupling ring 33 against coupling disk 30. The latter, by friction, rotatably drives ring 33 and consequently the shaft of coupling wheel 17. This shaft 17*a* further carries a heart-shaped cam 34 for zero setting of the chronograph seconds wheel 18.

The chronograph counter gear train is visible on FIGS. 1, 2, 4 and 5. The first wheel 35 of this gear train is pivotably mounted on a tubular member 36 (FIG. 2) force fitted in the support bar 24 of the timepiece gear train. This wheel 35, driven at a rate of one revolution each 30 minutes, meshes with an intermediate wheel 37 which in turn meshes with a minutes counting wheel 38 turning at the same speed as wheel 35 and in the same direction, by means of intermediate wheel 37. The shaft 38*a* of wheel 38 carries the minutes counter hand 39*a*. Wheel 38 and its shaft 38*a* are friction fitted together to allow an independent angular displacement of these two members above a given torque.

The pinion 35' of wheel 35 meshes with an intermediate wheel 40 whose pinion 40' meshes with the hours-counting wheel 41 whose shaft 41*a* carries the hours-counter indicating hand 39*b*. This wheel 41 and its shaft 41*a* are friction fitted together, like the minutes counting wheel, and for the same purpose. Because of this, when zero setting takes place, the shafts 38*a* and 41*a* can be angularly displaced relative to wheels 38 and 41.

The minutes counter shaft 38*a* and the hours counter shaft 41*a* are each solid with a respective heart-shaped zero setting cam 42, 43.

As explained above, the elastic disk 32 of the coupling wheel normally applies the coupling ring 33 against the coupling disk 30, as illustrated in thick lines in FIG. 3. The coupling ring 33 can be displaced axially by deformation of the elastic disk 32, as illustrated in thin lines in FIG. 3.

For this purpose, two levers 44, 45 are pivotally mounted about two shouldered screws 46, 47 (FIGS. 1 and 5). These levers 44 and 45 are each fitted with a finger 44*a*, 45*a* respectively having intersecting paths about the shoulder screws 46, 47. A spring 48 exerts a pressure on finger 45*a* which maintains the two levers in positions spaced apart from the coupling ring 33, their displacement being limited by an abutment 49. Lever 44 has a second finger 44*b* that penetrates between the contrate teeth of a column wheel 50 in the spaced-apart position of the levers. Lever 44 furthermore carries a pin 44*c* which, in the position illustrated in an unbroken line in FIG. 5, is located in the proximity of an indexing jumper 51 engaging with the toothing of intermediate wheel 37.

The column wheel 50 is solid with, and coaxial with, a ratchet wheel 42 (FIG. 1) engaging with a pawl 53 solid with one end of a lever 54 pivoted about a pin 55. This lever 54 is controlled by the chronograph's start-stop push-piece 5. A biassing spring 56 is disposed under the lever 54 and serves to return it to the rest position. The lever 54 has a countersink 54*a* in which an abutment 57 is engaged; this serves to limit the path of the lever 54 and hence the angular displacement of ratchet wheel 52, which is positioned by a spring-urged pawl 58.

The zero setting push-piece 6 engages with a first lever 59 provided with a pin 60 engaged in an elongated opening 61 of a second lever 62 having a finger 62*a* which is or is not locked by the column wheel 50, depending on the position thereof. The lever 59 is pivoted about a pin 63, whereas the lever 62 is pivoted about the abutment 57 which thus serves two purposes. A spring 64 terminates with two inclined planes forming an obtuse angle therebetween. One of these planes bears against the pin 60 of lever 59 and holds it in the position illustrated in FIG. 1; the other is inclined in such a manner that it constantly tends to return the pin 60 into this same position as soon as a pressure is no longer exerted on the push-piece 6. The elongated opening allows this lever 59 to return to the rest position independently of lever 62.

Lever 62 also carries a pin 65 (FIG. 4) engaged in an opening 66 of a zero setting member 67 carrying three hammers 68, 69, 70. This pin 65 serves to drive the zero setting member 67, as will be explained below. A positioning spring 71 for pin 65 terminates with two inclined planes one of which tends to hold lever 62 in the rest position, illustrated in FIG. 1, whereas the other tends to maintain it in a position engaged in the column wheel 50, which position corresponds to zero setting and to locking of the chronograph counter indicator members by engagement of the hammers 68, 69 and 70 with the cams 42, 34 and 43 respectively, as illustrated in broken lines in FIG. 4.

The zero setting member 67 has two elongated openings 72, 73 (FIGS. 1 and 4) having parallel longitudinal axes. Opening 72 engages with a shoulder screw 74 which leaves member 67 free to move relative to screw 74, whereas opening 73 engages with a pin 75. Because of this, when it is driven by the lever 62, the zero setting member 67 can move rectilinearly in the longitudinal direction of openings 72, 73. It should further be noted that the hammer 69 has an adjustment arrangement having an elongated opening **69*a* wherein a guide pin 76 is engaged, whereas securing and adjustment of the hammer 69 is provided by an eccentric 77. By means of this adjustment arrangement, the simultaneous contact of the hammers 68, 69, 70 with the shoulders of the three heart-shapes is guaranteed in the zero setting position illustrated in FIG. 4. As a variation, the hammer 69** could be mounted in an elastic manner on the zero setting member, which would give the same result.

In the position illustrated in an unbroken line in FIGS. 1 to 5, the chronograph mechanism is in operation. In this position, the coupling wheel 17 engages with the chronograph seconds wheel 18, whereas the retractable finger 27 abuts once per rotation with the toothing of the first wheel 35 of the chronograph gear train, i.e. once per minute, and causes it to move by one step. Driven by means of the intermediate wheel 37, the minutes counter wheel 38 hence also turns by one step, in the same direction as wheel 35. Because of the gear reduction due to pinion 35', wheel 40 and pinion 40', the hours counter wheel 41 also turns in the same direction as wheel 35, but through an angle 24 times less. Because the minutes counter wheel 38 and the hours counter wheel 41 are connected by a cinematic transmission, no lag can occur between them.

Between two actuations of the hours and minutes counter gear train by the retractable finger 27, the jumper 51 prevents this gear train from turning, by means of the cinematic transmission between these two counters.

When it is desired to stop the chronograph mechanism, a pressure is exerted on the push-piece 5 which makes the ratchet wheel 52 turn by one step via the intermediary of pawl 53. Consequently, the column wheel 50 turns through the same angle, so that finger **62*a* of lever 62 is unlocked. During this rotation, finger 44*b* of lever 44 moves into the position illustrated in thin lines in FIGS. 3 and 5. By means of fingers 44*a* and 45*a*, the lever 44 drives lever 45. These two levers 44, 45 lift the coupling ring 33, so that pinion 17' and coupling disk 30 turn, whereas shaft 17*a*, wheel 17 and cam 34** stop turning.

During the angular displacement of lever 44, the pin **44*c* comes to bear against a rear face of the jumper 51, hence locking the gear train of the chronograph counter mechanism. It is possible that this gear train stops at a moment when the retractable finger 27 is driving this gear train, so that, by rotation of the intermediate wheel 37 in the direction of arrow F (FIG. 5), the jumper is no longer bearing against two teeth of the intermediate wheel 37, but is lifted up, without the angle formed between the two inclined faces that normally bear on two teeth of this intermediate wheel having already passed to the other side of the tooth lifting it up. When the pin 44*c* meets the rear of the jumper 51, it pushes the jumper to the bottom of the intermediate wheel 37's toothing, causing this wheel to turn, as well as all of the wheels of the chronograph counter gear train, rearwardly by an angle less than one half of the pitch of wheel 35. The retractable finger 27 is consequently angularly displaced about its pin 28, hence tightening spring 26*a*. At the same time, the minutes counter hand 39*a* is returned to come to face a graduation of the dial. Thus, if the time measured corresponds to 9 minutes and 59 seconds for example, the hand 39*a*** will be facing the 9 minutes graduation and the seconds hand will be facing the 59 seconds graduation.

In this stopped position, two possibilities are available. Either the counter is set to zero, or a second time interval is measured, that is to be added to the previous one. In the latter case, a pressure is exerted once again on the push-piece 5, which causes the ratchet wheel 52 and the column wheel 50 to turn by one step. Levers 44 and 45 are returned into the position illustrated in thick lines in FIGS. 1, 3 and 5, freeing the jumper 51, so that the spring **26*a* can relax and so the retractable finger 27 returns the chronograph counter gear train into the angular position it occupied at the moment of the previous stoppage, enabling finger 27** to complete driving of this gear train uninterrupted by this new stoppage.

When the chronograph mechanism is stopped once again, it is for example possible to set the three counters to zero by exerting a pressure on push-piece 6. The latter firstly encounters a strong resistance as long as the pin 60 of lever 59 in on the first inclined plane of spring 64, which makes an angle of the order of 75° with the direction of the force exerted by push-piece 6. When pin 60 reaches the other inclined plane of spring 64, the force transmitted increases abruptly and very substantially. The finger **62*a* of lever 62 abruptly engages with the column wheel 50 and the hammers 68, 69, 70 of zero setting member 67 are forcibly applied against cams 42, 34 and 43, returning the three hands 39*a*, 19 and 38*b*** to zero.

Given that the chronograph counter gear train mechanism is held immobile by the jumper 51 locked by pin **44*c* and lever 44, the cams 42 and 43 solid with axles 38*a*, 41*a* respectively of wheels 38 and 41 turn with these axles and with the hands 39*a* and 39*b* relative to the wheels 38 and 41, which are friction fitted to these axles 38*a* and 41*a*, and are immobilized by jumper 51. As for the chronograph seconds wheel 18 and the coupling wheel 17, these can turn because the coupling ring 33 is spaced apart from the coupling disk 30**.

As soon as pressure ceases to be exerted on the push-piece 6 (FIG. 1), spring 64 pushes back pin 60 and lever 59 independently of lever 62, by means of the elongated opening 61 in which pin 60 is engaged. The lever 62 is held in engagement with the column wheel by the spring 71 acting on pin 65 until the start push-piece 5 is actuated once again. At this instant, the column wheel 50 pushes the lever 62 rearwardly. At the same time, the levers 44 and 45, whose column wheel 50 unlocks finger 44b, are spaced apart from the coupling ring 33 by spring 48.

The preceding description shows not only that there is a cinematic connection between the indicating members of the chronograph such as to prevent any angular lag therebetween, but also the number of rotating members forming the counter gear train is reduced to a minimum. It can also be observed that the coupling rotating member is eccentric which enables a substantial saving of space at the center of the movement, and also that the coupling rotating member is a simple intermediate wheel with a ratio of 1/1 between the watch movement seconds wheel 15 and the chronograph seconds wheel 18. As shown in broken lines in the cross sections of FIGS. 2 and 3, this off-centering of the coupling mechanism frees the center to allow mounting of an oscillating mass OS of an automatic winding mechanism without increase in the movement's height.

The small number of component parts of the chronograph mechanism and the fact that this mechanism is arranged at one side of the movement enables a maximum volume to be left for the essential members, barrel and balance. This low number of parts enables the mechanism's reliability to be improved. It has also been observed that intermittent driving of the counter gear train reduces the energy needed to be taken from the watch's mechanism, enabling improvement of its chronometric performance.

We claim:

1. A timepiece comprising a chronograph mechanism, said timepiece comprising:

counters comprising a seconds counter, a minutes counter and an hours counter, each of said counters comprising an indicating member fixed for rotation with a respective rotatable member, coupling means for selectively placing each said rotatable member in engagement with a gear train of the timepiece, a device for controlling said coupling means, a zero-setting mechanism for each said indicating member:

a cinematic transmission for connecting a first rotatable member fixed for rotation with a first indicator member of the minutes counter to a second rotatable member fixed for rotation with a second indicator member of the hours counter, an indexing member in engagement with said cinematic transmission, wherein said coupling means comprises other further rotatable members connected, on one hand, cinematically to a third rotatable member fixed for rotation with a third indicator member of the seconds counter and, on another hand, periodically to said cinematic transmission.

2. A timepiece according to claim 1, wherein said other further rotatable members of said coupling means comprise a first further rotatable member and a second further rotatable member mounted on a common axis, said first further rotatable member being free to turn about said axis, whereas said second further rotatable member is fixed for rotation with said axis, said first further rotatable member being fixed for rotation with a first coupling member whereas said second further rotatable member is fixed for rotation with a second coupling member which is axially displaceable and associated with elastic means substantially constantly tending to apply it axially against said first further coupling member, on said first rotatable member and said second further rotatable member engaging with another rotatable member fixed for rotation with a seconds wheel disposed eccentric to a timepiece movement and having a gear ratio of 1/1 therewith, whereas another of said first rotatable member and second further rotatable member is in engagement with said rotatable member fixed for rotation with the seconds indicator member at a center of a chronograph counter and having a gear ratio of 1/1 therewith, and wherein said control device of the coupling means comprises a mechanism for axially displacing said second coupling member against said elastic means.

3. A timepiece according to claim 1, comprising a locking member for said indexing member cinematically fixed with said control device of the coupling means to lock said indexing member with said cinematic transmission in an uncoupled position of said coupling means, wherein a frictional connection is established between respective rotatable members and indicator members of the minutes counter and hours counter.

4. A timepiece according to claim 1, wherein the zero setting mechanism comprises a zero setting member, guide means for guiding said zero setting member along a rectilinear path, said zero setting member comprising zero setting elements selected from the group consisting of a first zero setting element a second zero setting element, and a third zero setting element of which said first zero setting element and said second zero setting element are fixed relative to one another, whereas the third zero setting element is connected to said zero setting member by a member selected from the group consisting of elastic means and adjustment means.

5. A timepiece according to claim 2, comprising means for mounting an oscillatory mass of an automatic winding mechanism.

6. A timepiece according to claim 1, wherein said cinematic transmission comprises five rotatable members, a central rotatable member connected periodically to said further rotatable member of the coupling means said central rotatable member being connected, on one hand, to a rotatable member of the minutes counter by an intermediate rotatable member and, on another hand, to a rotatable member of the hours counter by another intermediate rotatable member.

* * * * *